US005263268A

United States Patent [19]

Meeks et al.

[11] Patent Number: 5,263,268

[45] Date of Patent: Nov. 23, 1993

[54] VACUUM DRYING SYSTEM WITH CRYOPUMPING OF SOLVENT RECOVERY FEATURE

[75] Inventors: Warren Meeks, Columbia, Md.; Yury Zlobinsky, Massapequa, N.Y.

[73] Assignee: Savant Instruments, Inc., Farmingdale, N.Y.

[21] Appl. No.: 818,779

[22] Filed: Jan. 13, 1992

[51] Int. Cl.[5] ..... F26B 13/30

[52] U.S. Cl. ..... 34/92; 34/15

[58] Field of Search ..... 34/72, 79, 92, 15, 54; 62/55.5

[56] References Cited

U.S. PATENT DOCUMENTS

| | | | |
|---|---|---|---|
| 4,053,990 | 10/1977 | Bielinski | 34/92 |
| 4,074,440 | 8/1978 | Nohara et al. | 34/92 |
| 4,584,781 | 4/1986 | Parkinson et al. | 34/92 |
| 5,025,571 | 6/1991 | Zlobinsky et al. | 34/92 |

*Primary Examiner*—Henry A. Bennet
*Assistant Examiner*—Denise L. Gromada
*Attorney, Agent, or Firm*—Thomas R. Morrison

[57] ABSTRACT

In the drying of solvents-containing material in a vacuum concentrator and which involves condensation of evolved solvents in a cold trap, simplified and inexpensive flow blocking devices are provided intervening an outlet of the cold trap and an inlet to the vacuum pump with which the concentrator is evacuated. The flow blocking practiced allows cryopumping effect to ensue between the concentrator and cold trap such being the agency by which solvent vapor outflows from the concentrator and is recovered by condensation thereof in the cold trap. Near complete solvent recovery can be achieved and carryover of solvent to the vacuum pump is reduced to insignificant measure. In one form, flow blocking is attained by use of a simple pressure differential valve. This valve will stay closed as long as absolute pressure differential acting on the valve is a desired value, such as one corresponding to difference of condition of vacuum at pump inlet and at the upstream end of the valve, such differential being one at which cryopumping conditions exist. If the differential is greater, the valve will open to reconnect system flow to the vacuum pump which continues until cryopumping condition is again achieved when the valve will again close. Flow blocking also readily can be provided with a solenoid operated valve, the solenoid being controlled by a pressure differential switch sensing condition of vacuum at the pump inlet and at a location upstream in the system. When the differential of vacuum conditions sensed is as desired, the switch is closed maintaining a signal to the valve keeping it closed allowing cryopumping of solvent to occur. When the sensed differential is greater than desired, the switch opens, the signal terminates and the valve opens to connect the system to the vacuum pump.

14 Claims, 1 Drawing Sheet

VACUUM DRYING SYSTEM WITH CRYOPUMPING OF SOLVENT RECOVERY FEATURE

BACKGROUND OF THE INVENTION

The present invention relates to the drying of solvents-containing materials in a vacuum concentrator and, more particularly, to nearly complete recovery of the solvent in a cold trap by means of cryopumping effect existing between the concentrator and cold trap with the result that only insignificant amounts of solvent can pass from the system into the system vacuum pump.

Our pending application Ser. No. 07/549,447, filed Jul. 6, 1990, now U.S. Pat. No. 5,137,604, granted Aug. 11, 1992, discloses a vacuum drying system in which solvent vapors evolve from solvents-containing material in a concentrator or vacuum chamber evacuated by a vacuum pump. These solvent vapors feed from the concentrator into a condensation cold trap located in a conduit connecting the concentrator and pump, the trap being intermediate the locations of the concentrator and pump. A valve is located between the outlet of the cold trap and the inlet to the vacuum pump, and opening and closing of this valve is microprocessor controlled in accordance with vacuum condition in the concentrator.

When the vacuum condition, i.e., absolute pressure in the concentrator is at a certain value, the microprocessor closes the valve and pump effect on the system is interdicted so that solvent cannot be drawn beyond the cold trap and into the vacuum pump. By keeping solvent from entering the vacuum pump, adverse effect on pump lubricant and/or internal pump structure is minimized. Interdiction function of the valve will be present during most of the drying cycle, but solvent will continue to pass from the concentrator to the cold trap by reason of cryopumping effect existing because of difference between the vapor pressure of the solvent in the concentrator and a lower absolute pressure in the cold trap.

When an absolute pressure rise occurs in the system that would weaken system cryopumping conditions, the control unit will signal opening of the valve to connect the pump with the chamber and until a certain condition of vacuum or lowered absolute pressure is restored in the chamber at which time, the control unit will signal closing of the valve so that continued evolution of the solvent from a material being dried in the chamber can proceed solely by way of cryopumping.

While this system works quite effectively for the intended purpose of protection of the pump and its lubricant, and for complete and reasonably timed solvents-containing material drying, it requires use of an expensive microprocessor control unit and devices that are all power operated.

Accordingly, it is desirable that drying apparatus of the type disclosed in our copending application be improved to achieve the intended apparatus purpose while using more simplified and inexpensive components in regard to the opening and closing of the valve which isolates or connects the cold trap with the vacuum pump.

OBJECTS AND SUMMARY OF THE INVENTION

Accordingly, it is an object of the invention to provide a vacuum drying system with cryopumping feature which overcomes the drawbacks of the prior art.

It is a further object of the invention to provide such system wherein cryopumping conditions are maintained and automatically monitored with most simplified and inexpensive devices.

It is a still further object of the invention to provide a vacuum drying system with cryopumping feature in which system connection with the vacuum pump is minimized in terms of time, yet effects complete material drying with maximized solvent recovery.

An additional object of the invention is to prolong pump service life and that of pump lubricants as well.

Briefly stated, there is provided in the drying of solvents-containing material in a vacuum concentrator and which involves condensation of evolved solvents in a cold trap, simplified and inexpensive flow blocking devices intervening an outlet of the cold trap and an inlet to the vacuum pump with which concentrator evacuation is effected. Flow blocking allows that solvent evolution to the cold trap and condensation therein can continue by the agency of cryopumping without recourse to flow connection with the vacuum pump thereby providing that near complete solvent recovery is achieved but solvent carryover to the pump reduced to insignificant measure. One form of flow blocking is attained with a pressure differential valve interposed between the cold trap outlet and the pump inlet. The pressure differential valve, stays closed as long as a pressure differential between the pump inlet and the downstream side of the cold trap is at desired value, such as being for example, about 50 Torr or less, this being a sufficient differential for cryopumping to be sustained. If the differential is greater, the pressure differential valve will open to reconnect system flow to the vacuum pump until pressure differential desired for effective cryopumping is again achieved, when the pressure differential valve will close. Flow blocking also can be provided with a solenoid operated valve, the solenoid being controlled by a pressure differential switch sensing condition of vacuum at pump inlet and at a location upstream in the system. When a sensed pressure differential at these points, that is, when a differential between the absolute pressures at these points is more than a desired value, the switch initiates a signal to the valve solenoid, closing the valve.

In accordance with these and other objects of the invention, there is provided in apparatus for removing solvents from a solvents-containing material in the course of a drying operation, which apparatus includes a chamber in which material to be dried is received, a vacuum pump which evacuates the chamber. A conduit connects the chamber with the vacuum pump, and this pump is operable to produce a stated condition of vacuum at an inlet to the pump. It also produces predetermined conditions of vacuum at a number of locations in the conduit upstream of the pump inlet which predetermined conditions of vacuum successively represent absolute pressure values increasingly higher than that of the stated vacuum condition the more remote the location from the pump inlet so that successive expected absolute pressure differentials exist between the pump inlet and successive ones of these locations. A cold trap is in the conduit downstream of the chamber into which solvent caused to evolve from the material under the influence of vacuum acting thereon, can evolve and be condensed, the cold trap being upstream of the pump inlet. A flow control element is located in the conduit intervening the cold trap and the pump inlet and is positionable to have flow passing and flow blocking orientations. Flow control element orientation means is provided and is effective responsive to presence of a greater differential of absolute pressure between the pump inlet and a given one of the said locations than expected, to produce actuation of the flow control element to a flow passing orientation. This means also is responsive to presence of expected or less than expected differential of absolute pressure between the pump inlet and said given one location to produce actuation of the flow control element to blocking orientation.

According to feature of the invention, there is further provided in apparatus for removing solvents from a solvents-containing material in the course of a drying operation, which apparatus includes a chamber in which the material to be dried is received, a vacuum pump with a conduit connecting the chamber with the pump. The vacuum pump is operable to produce a stated condition of vacuum at an inlet to the pump and predetermined conditions of vacuum lesser than said stated value upstream of the pump inlet. A cold trap is in the conduit and intervenes the chamber and the pump inlet. Solvent which is caused to evolve from the material under the influence of vacuum acting thereon flows into and is condensed in the cold trap. A pressure differential valve is in the conduit and intervenes the pump inlet and an outlet of the cold trap. The pressure differential valve is spring controlled and such spring is characterized by its maintaining a valve closure component in flow checking condition whenever a differential of absolute pressure between that at the pump inlet and at a conduit location immediately upstream of the pressure differential valve is less than a differential as represented by the stated vacuum condition, and a predetermined condition of vacuum at said immediately upstream conduit location.

The invention provides that in the case where a spring-loaded valve is employed for flow blocking purpose, the expected differential of vacuum at which the valve would remain closed during cryopumping status could, for example, be about 50 Torr or less. Generally with current vacuum pump types, the condition of vacuum at the pump inlet which is the greatest such condition in the system, will be about 0.01 Torr. This means that a spring whose characteristics and load imposition is effective to apply an equivalent of about 50 Torr pressure is suitable for use in the valve and will maintain same closed when the condition of vacuum at cold trap outlet is about 50 Torr. With cold trap outlet vacuum of about 50 Torr, the condition in the trap is fully promotive of and will sustain cryopumping flow of solvent vapor from the vacuum chamber to entry into and condensation in the trap without need for system connection to the vacuum pump.

According to a further feature of the invention, control of the flow control element in the conduit to orient such for flow blocking or flow passing orientation can be done with use of a pressure differential switch. In such use, a pressure sensing switch which is connected at opposite sensing sides thereof with the inlet to the vacuum pump and a given location upstream of the pump inlet senses a differential of absolute pressure represented by vacuum condition at these two system points. If the absolute pressure differential is at or less than expected, the switch remains closed and a power signal is applied to the solenoid valve to hold it closed. If the sensed differential is greater, the switch closes and power signal to the valve is terminated whereby it opens reconnecting the system to the pump inlet until the differential is reduced to that expected and cryopumping status can proceed independent from vacuum pump effect.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The present invention deals with drying solvents-containing specimens such as biological specimens. Vacuum conditions in the drying system and depending on the materials involved will usually be very high approaching maximum possible vacuum although lesser levels may be applicable in a particular circumstance. Maximum system condition of vacuum always will be at inlet to the vacuum pump where it is contemplated vacuum condition will be about 0.01 Torr. Vacuum condition upstream of that point will be less and generally least in the concentrator wherein for example, heating of the specimen may be practiced to facilitate the drying process, this heating producing solvent vapor pressurization.

With regard to description of vacuum condition herein, it will be understood that a "high condition of vacuum" means correspondingly a low absolute pressure so that a vacuum condition of say, 10 Torr, means a near absence of absolute pressure. If a condition of vacuum is said to decrease, it means an increase in absolute pressure and vice-versa.

Figure 1:
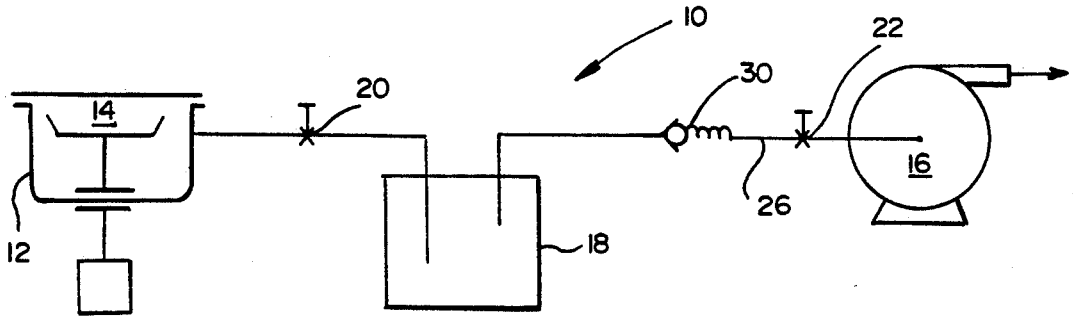
FIG. 1 is a schematic depiction of a first embodiment of vacuum drying apparatus with which solvents are removed from solvents-containing material in accordance with the principles of the present invention.

Referring now to FIG. 1, the vacuum drying system embodiment 10 there shown, includes a vacuum concentrator 12 having a drying chamber space 14 therein in which is received a solvents-containing material to be dried, this unit being of the type disclosed in commonly owned U.S. Pat. No. 4,226,669. The system depicted can, for example, be comprised of a Savant Instruments, Inc., SPEEDVAC Model SC100 or SC200 concentrator, a RT400 cold trap, and a VP100 vacuum pump as the principal components.

Vacuum pump unit 16 can be of various types but desirably will be a staged type to allow obtainment of a very high vacuum condition in the system as will be discussed later. Intermediate the vacuum pump 16 and concentrator 12, a condensation or cold trap 18 is provided, the cold trap being maintainable at, e.g., a temperature of minus 60 degrees C. for condensing of volatile solvents therein.

Shut-off valves 20, 22 (which can be manually operated) can be provided at the outlet of the concentrator and just before inlet to the vacuum pump, these valves being open during the drying operation.

It is to be understood that once a desired system operation condition of vacuum is achieved, vacuum pump connection or communication to the cold trap and concentrator is to be minimized. A desired high condition of vacuum or very low absolute pressure in the concentrator chamber represents a predetermined vacuum condition in such chamber. This vacuum condition coupled in some cases with heat application to the material being dried effects the evolution of solvent in vapor form from the material. The solvent vapor is then condensed in the cold trap 18. Once though that a requisite condition of vacuum is reached in the chamber 14, and particularly in the cold trap 18, pump effect on the chamber is not necessary since by establishment and maintenance of cryopumping conditions between the cold trap and the chamber, solvent evolution will endure even though communication between the pump and components upstream thereof such as the cold trap and chamber is interdicted.

Regarding system conditions, maximum condition of vacuum therein will, as noted above, be at the inlet to the vacuum pump where the vacuum will be of a stated value, such as 0.01 Torr. With such stated vacuum condition, lesser values of vacuum will be found the more remote a location is from the pump inlet. Such other values will of course, have predetermined or desired values of vacuum condition. Thus and by way of example, vacuum condition immediately downstream of the cold trap could be about 10 Torr. Upstream of the cold trap it could be about 15 Torr, and in the chamber perhaps a little less, that is, absolute pressure in the chamber is higher than that in the system upstream of the cold trap.

With values in the system as last noted, these would be associated with cryopumping conditions. If the condition of vacuum at a given one of the referred-to locations decreases, say from 10 Torr at the outlet of the cold trap to say 50 or even 85 or 90 Torr, such would indicate weakening of cryopumping conditions and that such should be restored by reconnecting the system with the vacuum pump to increase the condition of vacuum at cold trap outlet to 10 Torr to assure that cryopumping will proceed. With such, interdiction of the conduit length 26 connecting the cold trap and pump can again be effected to the salutary end of barring solvent carryover to the pump.

In the FIG. 1 apparatus 10, a most responsive, simplified and inexpensive manner of controlling interdiction of conduit length 26 is to use a differential pressure valve 30 in-line connected in the conduit length, this valve being depicted schematically in FIG. 1. Valve 30 functions to open and close according to what absolute pressure differential is between the respective inlet and outlet ends thereof.

The valve 30 need embody only a closure element and bias means acting on the closure element to move it between flow passing and flow blocking orientations. The bias means can be a spring and the spring characteristics designed so that the spring can maintain the closure element blocking whenever the pressure differential is at a selected value of say about 10 Torr or about 50 Torr or whatever differential it is determined allows proper cryopumping conditions to endure. If the differential is a greater than the selected value, the spring force will be insufficient to hold the closure member in closed orientation, the valve will open to connect the pump to the system upstream and the influence of the vacuum pump will work to restore vacuum condition to one wherein the pressure differential will be brought back to the selected level and the valve will close.

Figure 2:
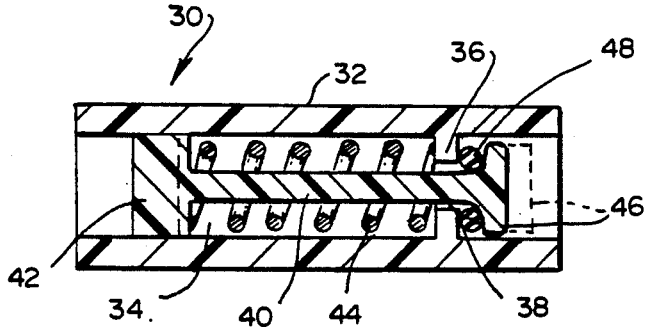
FIG. 2 is a longitudinal, central sectional view of the pressure differential type valve used in the FIG. 1 apparatus to control the cryopumping operation which ensues in the refrigerated trap during the vacuum drying operation.

Exemplary of such valve construction is that shown in section in FIG. 2, which is a cartridge check valve No. 140 PPV as manufactured and sold by Smart Products, Inc. of San Jose, Calif. This component is highly reliable in its operation, of low cost, and long service-life expectancy. As seen from FIG. 2, the check valve 30 has a barrel-like body 32, bored as at 34 but with an annular inner seat part 36 which is ported as at 38.

A rod 40 is received in the body 32 and is enlarged as at one end with a piston piece 42, the rod being encircled by a compression coil spring 44 that is confined between an inner face of the piston piece and a left face of the seat part. At the opposite side of the seat part 36, the rod passing through the port 38 is headed as at 46 and rearwardly of the head has a ring groove holding a resilient ring 48, this ring being urged normally against the right face of the annular seat part to close port 38 and bar flow passage through the barrel body. The valve is shown in closed condition in solid lines in FIG. 2. The open condition, occurs when the rod 40 is moved rightwardly along with head 46 as shown in dashed lines to uncover the port 38 and thus permit flow passage through the barrel body.

Spring 44 is selected to have characteristics as recited above so that when a differential pressure between stated condition of such at the pump inlet and to which the right end of the valve and its head part 46 are exposed, and a predetermined condition at outlet of the cold trap and to which the left end and piston part 42 are exposed, is greater than expected, the bias of the spring will not be sufficient to keep the seal ring 48 tightly covering port 38 and the valve will open to reconnect pump effect in order to increase the vacuum condition in the system upstream of the pump and particularly at the outlet of the cold trap so that cryopumping conditions are restored.

Spring 44 should have strength to exert the equivalence of 10 Torr or 50 Torr or other selected differential, against the piston part 42 to urge it leftwardly to close the valve. By using the check valve 30, the system is in a sense self operational in regard to maintaining cryopumping conditions. The spring responds to the vacuum condition differential situations to open or close the valve as needed. This is a much simplified arrangement eliminating a microprocessor as used heretofore.

Figure 3:
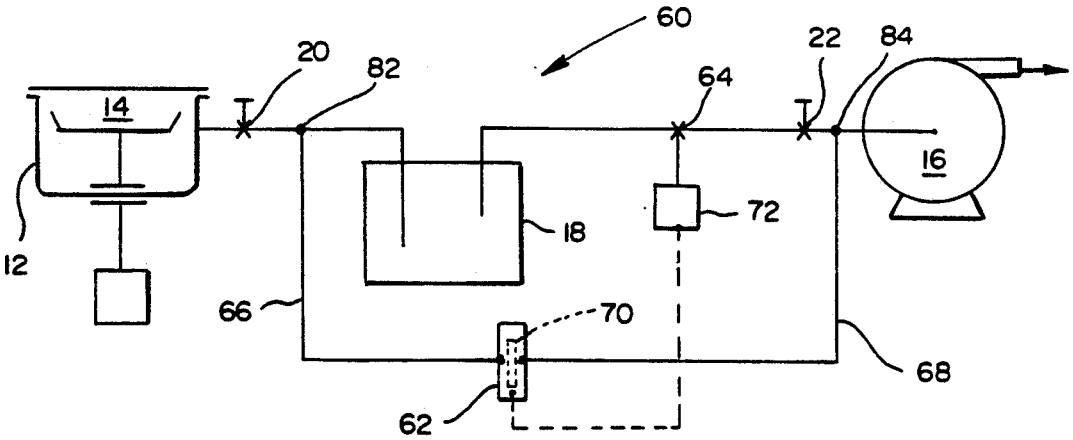
FIG. 3 is a schematic depiction of another apparatus embodiment wherein a differential pressure actuated switch is employed to control the cryopumping operation.

FIG. 3 illustrates another embodiment of apparatus 60 which employs relatively inexpensive means to control connection or interdiction of the cold trap and chamber with the vacuum pump. Where the components of apparatus 60 are the same as and used for the same purpose as in the apparatus 10, the like reference numerals are employed.

Apparatus 60 uses a pressure differential switch 62 such as a MPL-900 switch as manufactured and sold by Micro Pneumatic Logic, Inc. of Fort Lauderdale, Fla. to control connection to the pump 16. The switch 62 is employed in conjunction with a solenoid operated valve 64 downstream of the cold trap outlet 18.

Switch 62 is connected at one side thereof with a system upstream location, as at 82, for sensing of vacuum condition at that location. An opposite side of the switch senses the stated condition of vacuum at the pump inlet as at 84, the respective sensing communicating lines being depicted as 66 and 68, respectively. If absolute pressure differential as represented by the difference of condition of vacuum between the pump inlet and the given upstream location is greater than expected, this means the pump should be connected to the chamber to increase the condition of vacuum at the given location so that cryopumping condition can be reestablished.

The switch 62 has an internal diaphragm arrangement (not shown) which controls switch contact orientation. If the differential is as expected, the switch contact 70 is oriented closed and a signal application of power to solenoid 72 of valve 64 to keep the valve closed. If the pressure differential is greater than expected, the switch contact moves to open position and the signal to the solenoid 72 of valve 64 terminated causing the valve to open. When the condition of vacuum at the sensed upstream location in increased to bring the differential of vacuum condition acting on the switch 62 back to an expected difference, the contact 70 will close, the electrical signal will be generated and the valve 64 will close.

Switch 62 will of course be designed and selected for use, to actuate at a selected pressure differential value.

In the FIG. 3 apparatus, the sensed conditions of vacuum are by way of example, greater than 50 Torr at the upstream location 84, and 0.01 Torr at the pump inlet sensed location 84. Sensing at other locations is possible, it being understood that it is to the particular differentials involved that the switch will be responsive.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for removing solvents from a solvents-containing material in the course of a drying operation, comprising a chamber in which material to be dried is received, a vacuum pump, a conduit connecting the chamber with the vacuum pump, the vacuum pump being operable to produce a condition of vacuum at an inlet to the pump and predetermined conditions of vacuum at a number of locations in said conduit upstream of the pump inlet which predetermined conditions of vacuum successively have values increasingly less than the pump inlet vacuum condition the more remote the location from the pump inlet so that successive expected absolute pressure differentials exist between the pump inlet and successive ones of the locations, a cold trap in the conduit downstream of the chamber into which solvent caused to evolve from the material under the influence of vacuum acting thereon can flow and be condensed, the cold trap being upstream of the pump inlet, a flow control element located in the conduit intervening the cold trap and the pump inlet and positionable to have flow passing and flow blocking orientations, and flow control element orientation means operable responsive to presence of a greater differential of absolute pressure between the pump inlet and a given one of said locations than an expected differential to produce actuation of the flow control element to flow passing orientation, said means being operable responsive to presence of an expected or less than expected differential of absolute pressure between the pump inlet and said given one location to produce actuation of the flow control element to blocking orientation.

2. The apparatus of claim 1 in which the flow control element and the flow control element orientation means are embodied as a differential pressure valve.

3. The apparatus of claim 2 in which the differential pressure valve is a spring-loaded check valve.

4. The apparatus of claim 1 in which the flow control element includes a housing having an inlet end and an opposite outlet end, the housing inlet end being in communication with one of said conduit locations upstream of the pump inlet and the housing outlet end being in communication with the inlet to the pump, and a valve element movably mounted in said housing for movement between flow blocking and flow passing orientations, the orientation means including a spring member engageable with the valve element for urging it into flow blocking orientation, said valve element having oppositely located surfaces exposed to vacuum condition presence at the housing opposite ends whereby differential of absolute pressure acts on said valve element tending to move it, the spring member having urging characteristics sufficient to urge the valve element into flow blocking orientation whenever the said expected or less than expected differential of absolute pressure is present but being insufficient to prevent movement of the valve element to flow passing orientation when greater differential of absolute pressure between that at the pump inlet and that at a location upstream of the pump inlet is present.

5. The apparatus of claim 4 in which the housing includes a seat containing a port, the valve element in blocking orientation being urged against said seat in port covering disposition by the spring member.

6. The apparatus of claim 4 in which the urging characteristics of the spring member are such as to hold the flow element in flow blocking orientation whenever the expected differential of absolute pressure condition is more than about 50 Torr.

7. The apparatus of claim 4 in which the urging characteristics of the spring member are such as to hold the flow element in flow blocking orientation whenever the expected differential of absolute pressure condition is more than about 10 Torr.

8. The apparatus of claim 1 in which the flow control element is a power operated device, the orientation means including a pressure differential sensing switch actuatable to a switch closed position whenever expected or less than expected differential of absolute pressure is sensed by the switch, said sensing switch in a closed position thereof being operable to signal application of power to the flow control element.

9. The apparatus of claim 8 in which the sensing switch has a pair of ports at opposite sides of a movable sensing member, one such port being communicated with the pump inlet, the other port being communicated with the said given one location.

10. The apparatus of claim 9 in which the said given one location is upstream of the cold trap.

11. The apparatus of claim 8 in which the flow control element is a solenoid operated valve.

12. Apparatus for removing solvents from a solvents-containing material in the course of a drying operation, comprising a chamber in which the material to be dried is received, a vacuum pump, a conduit connecting the chamber with the vacuum pump, the vacuum pump being operable to produce a condition of vacuum at an inlet to the pump and predetermined conditions of vacuum upstream of the pump inlet which have values which are less than said pump inlet vacuum condition, and a cold trap in the conduit intervening the chamber and the pump inlet, solvent caused to evolve from the material under the influence of vacuum acting thereon flowing into and being condensed in the cold trap, a differential pressure valve in the conduit intervening the pump inlet and an outlet of the cold trap, the valve embodying a spring urging a closure element in a flow checking condition whenever an absolute pressure differential between that at the pump inlet and at a conduit location immediately upstream of the valve is at or less than a differential between a vacuum condition at the pump inlet, and a predetermined condition of vacuum at said immediately upstream location.

13. The apparatus of claim 12 in which the spring is effective to maintain the valve in checking condition whenever the differential of vacuum condition between the pump inlet and the upstream location is 50 Torr or less.

14. The apparatus of claim 12 in which the differential pressure valve is a spring-loaded check valve.

* * * * *